United States Patent [19]

Ofusa

[11] Patent Number: 4,561,474

[45] Date of Patent: Dec. 31, 1985

[54] WOVEN SLIDE FASTENER STRINGERS

[75] Inventor: Masaatsu Ofusa, Kurobe, Japan

[73] Assignee: Yoshida Kogyo K.K., Tokyo, Japan

[21] Appl. No.: 671,311

[22] Filed: Nov. 14, 1984

Related U.S. Application Data

[62] Division of Ser. No. 441,397, Nov. 12, 1982.

[30] Foreign Application Priority Data

Nov. 19, 1981 [JP] Japan ..... 56-185658
Dec. 29, 1981 [JP] Japan ..... 56-197188

[51] Int. Cl.[4] ..... D03D 3/00
[52] U.S. Cl. ..... 139/384 B; 24/392
[58] Field of Search ..... 139/384 B; 24/205.1 C, 24/205.16 R, 205.16 C, 391, 392, 393

[56] References Cited

U.S. PATENT DOCUMENTS 3,961,652 6/1976 Hasuda et al. ..... 139/384 B
4,362,191 12/1982 Frohlich et al. ..... 139/384 B
4,404,998 9/1983 Frohlich et al. ..... 139/384 B

*Primary Examiner*—H. Jaudon
*Attorney, Agent, or Firm*—Hill, Van Santen, Steadman & Simpson

[57] ABSTRACT

A woven slide fastener stringer includes an edge portion woven of foundation warp threads and a single foundation weft thread which is laid in a series of pairs of weft picks. A row of filamentary coupling elements is disposed against one side of the longitudinal edge portion with two pairs of picks provided for each coupling element, one pair at each side of the adjacent leg. A binding warp thread system has threads which engage the upper legs remotely from the edge portion and which extend downwardly to pass beneath one or two pairs of weft thread. By this arrangement, the coupling elements are stably secured in position.

6 Claims, 9 Drawing Figures

WOVEN SLIDE FASTENER STRINGERS

This is a division of application Ser. No. 441,397, filed Nov. 12, 1982.

BACKGROUND OF THE INVENTION

1. Field of the Invention

The present invention relates to a woven slide fastener stringer having a row of continuous filamentary coupling elements woven integrally into a stringer tape.

2. Prior Art

Various methods and apparatus for manufacturing woven slide fastener stringers have been proposed and used. An apparatus disclosed in Japanese Laid-Open Patent Publication No. 50-36,249 published Apr. 5, 1975 has a rotor for coiling an element-forming filamentary material of synthetic resin in a conical orbital path around a mandrel into a row of coupling elements as they are woven into a stringer tape in synchronism with the weaving of the latter. The known apparatus is complex in construction and hence needs tedious and time-consuming adjustment and maintenance.

According to another known apparatus shown in West German Laid-Open Patent Publication No. 2,221,855 published Nov. 30, 1972, an element-forming filamentary material is coiled into a row of coupling elements without using a rotor and a mandrel, the coupling elements being woven into a stringer tape as the latter is woven. The apparatus includes a rocker arm angularly movable in a plane substantially parallel to the general plane of the stringer tape for moving a hook into and out of a warp shed across warp threads to coil the element-forming filamentary material around the hook. The hook thus arranged is likely to interfere or otherwise damage the warp threads, particularly when the apparatus operates at a relatively high speed. A small-sized hook may reduce damage to the warp threads but is apt to fail to catch the element-forming filamentary material.

SUMMARY OF THE INVENTION

An element-forming filamentary material of synthetic resin, supplied to a fell of a stringer tape being woven along a longitudinal path extending between and substantially parallel to warp threads of the stringer tape, is displaced by an angularly movable pusher arm out of the longitudinal path into a position outside the warp threads. A hook angularly moves alongside the warp threads to hook the element-forming filamentary material at said position and to bring the same into another position adjacent to and aligned with the fell, thereby coiling the filamentary material around a rectangular nose portion of the hook into a coupling element.

An object of the present invention is to provide a woven slide fastener stringer produced by the apparatus. Such fastener stringer has a row of coupling elements fixed to a stringer tape with an increased degree of binding strength by means of a binding warp thread system having patterns similar to sewing stitches.

Many other advantages, features and additional objects of the present invention will become manifest to those versed in the art upon making reference to the detailed description and the accompanying drawings in which certain preferred embodiments incorporating the principles of the present invention are shown by way of illustrative example.

DETAILED DESCRIPTION

Figure 1:
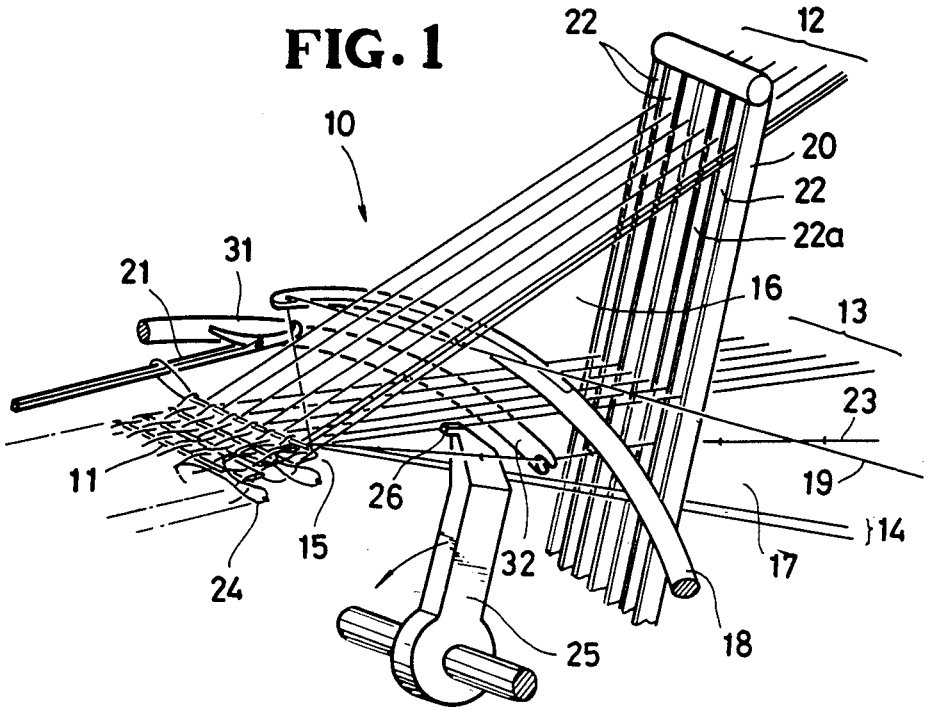
FIGS. 1 and 2 are schematic perspective views of an apparatus, the views showing parts in different positions while the apparatus is in operation to produce a woven slide fastener stringer according to the present invention.
Figure 2:
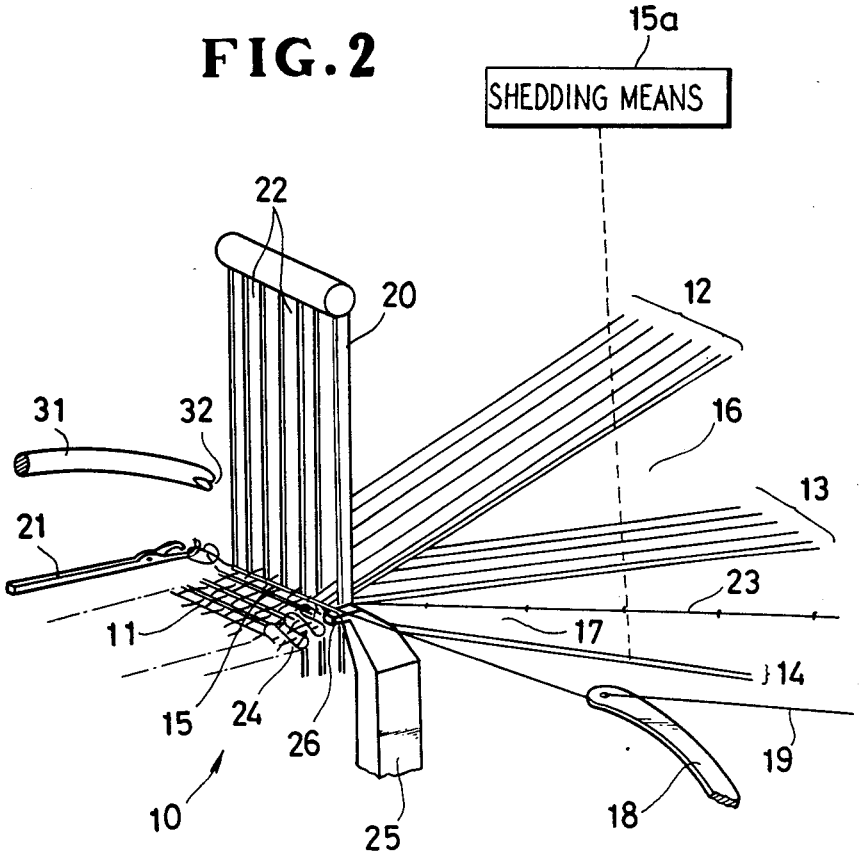

FIGS. 1 and 2 illustrate an apparatus for manufacturing a woven slide fastener stringer in accordance with the present invention. The apparatus comprises a loom 10 for progressively weaving a stringer tape 11 of warp threads 12, 13, 14 at a fell 15, the loom 10 including conventional heddles or a shedding means 15*a* shown diagrammatically for forming a pair of upper and lower warp sheds 16, 17 between the warp threads 12, 13, 14 and for selectively moving the warp threads 12, 13, 14 up and down, a filling carrier or weft inserter 18 disposed at one edge of the warp threads 12, 13, 14 and angularly movable for inserting a weft thread 19 in the upper shed 16 between the warp threads 12, 13, a reed 20 movable back and forth for beating the weft thread 19 inserted in the shed 16 against the fell 15, and a knitting needle 21 reciprocably disposed at the opposite edge of the warp threads 12, 13, 14 for successively knitting loops of the weft thread 19 projecting out the warp shed 16 to form a tape selvage. The reed 20 has a plurality of longitudinal slots 22 through which the warp threads 12, 13, 14 extend from the heddle 15*a* to the fell 15. An element-forming filamentary material of synthetic resin 23, which has a plurality of prospective coupling head portions 47 (FIGS. 5 and 6) formed in advance thereon at equal intervals, is introduced in the lower warp shed 17 through the second endmost slot 22*a* to the fell along a longitudinal path extending between and substantially parallel to the warp threads 12, 13, 14. The longitudinal slot 22*a* through which the filamentary material 23 passes is selected on the basis of the length L (FIG. 5) of the coupling element to be formed.

Figure 3:
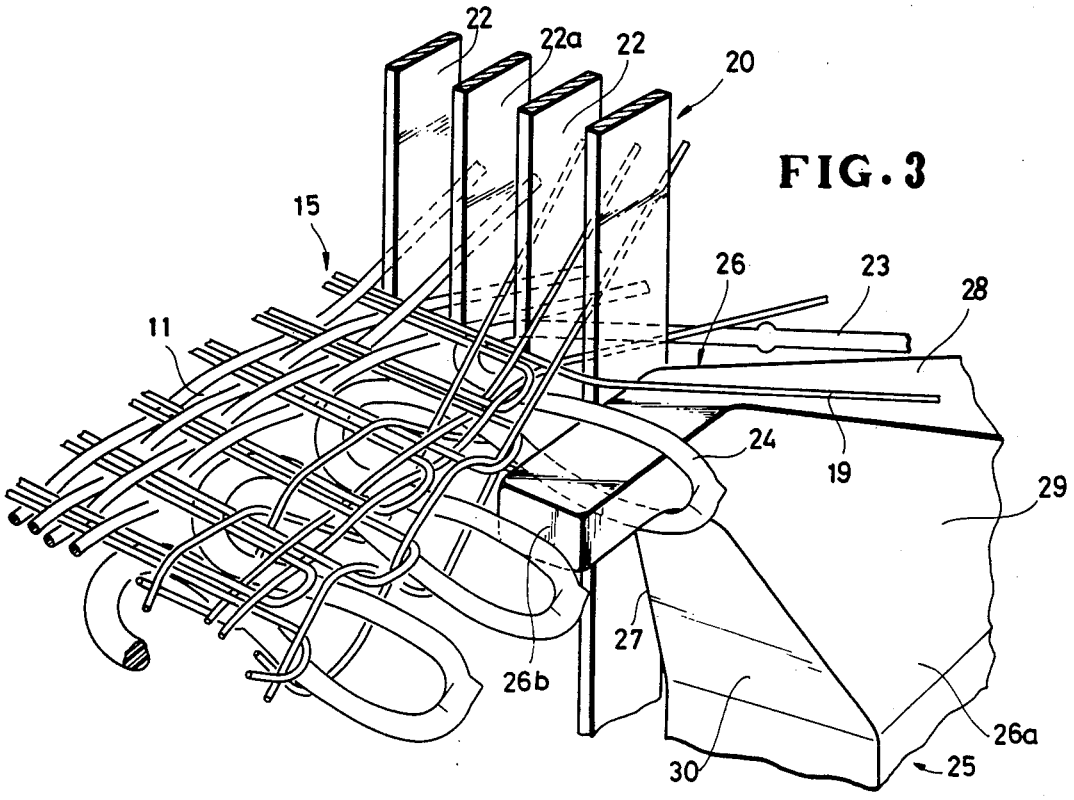
FIG. 3 is an enlarged perspective view of a portion of the apparatus shown in FIG. 2.

The apparatus also includes a coiling means operable in synchronism with the loom 10 for coiling the element-forming filamentary material 23 into a row of coupling elements 24 whereby the row of coupling elements 24 is woven integrally into the stringer tape 11 as the latter is woven. The coiling means comprises a rocker arm 25 disposed at the one edge of the warp threads 12, 13, 14 and rockingly movable about its one end. As shown in FIG. 3, the rocker arm 25 has at the opposite or distal end a hook 26 including a head portion 26*a* and a nose portion 26*b* projecting from the head portion 26*a* in a direction parallel to the warp threads 12, 13, 14 and hence to the path of the filamentary material 23. The nose portion 26*b* is in the form of a rectangular block and has a transverse cross section which defines a space between a pair of upper and lower legs of each coupling element 24. The head portion 26*a* has a shape like the frustum of a pyramid defined by four slanted surfaces 27, 28, 29, 30. The slanted surfaces 27–30 enable the filamentary material 23 to slide smoothly thereon and over the nose portion 26*b*. Upon rocking movement of the rocker arm 25, the hook 26 moves, in a plane substantially perpendicular to the general plane of the stringer tape 11, between a first postion shown in FIG. 2 and in which it is located in alignment with the fell 15 and a second position shown in FIG. 1 in which it is located remotely from the fell 15.

Figure 5:
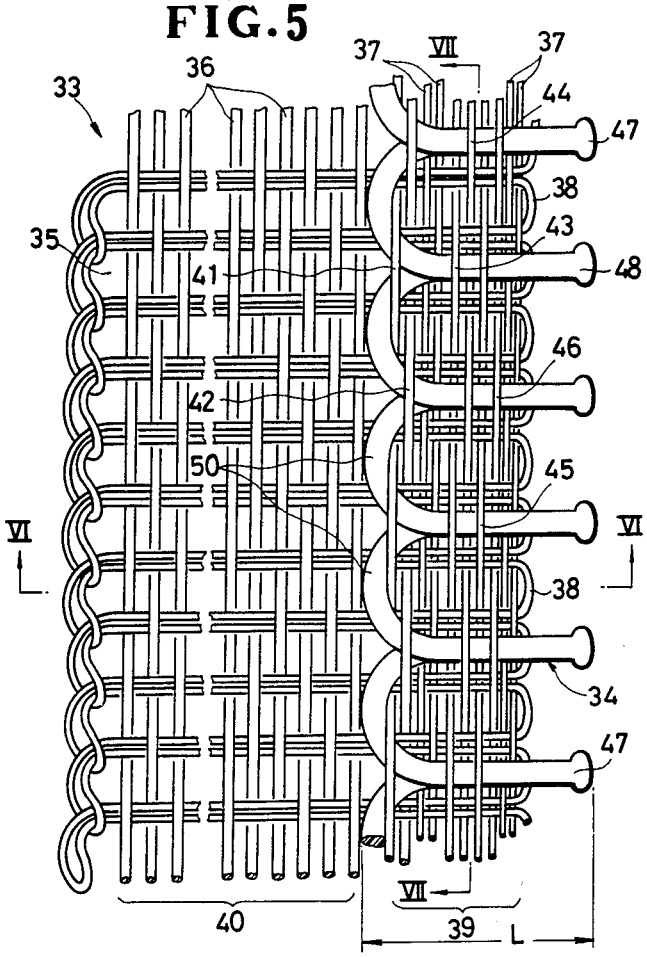
FIG. 5 is an enlarged schematic plan view of a woven slide fastener stringer according to the present invention.
Figure 6:
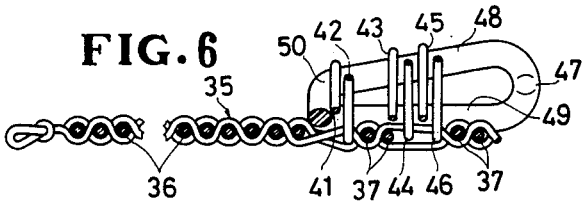
FIG. 6 is a transverse cross-sectional view taken along line VI—VI of FIG. 5.

The coiling means also includes an arcuate pusher arm 31 disposed at the opposite edge of the warp threads 12, 13, 14 and angularly movable across the lower warp shed 17. The pusher arm 31 has a bifurcated end portion 32 for receiving therein the element-forming filamentary material 23 having the equidistantly spaced prospective coupling head portions 47 (FIGS. 5 and 6). The pusher arm 31 is actuated in timed relation to the rocker arm 25 so that while the hook 26 is at its second position shown in FIG. 1, the bifurcated end portion 32 of the pusher arm 31 engages the element-forming filamentary material 23 and displaces it by pushing the same outside the warp threads 12, 13, 14 beyond the inclined surfaces 28, 29 of the hook's head portion 26*a*.

The apparatus operates as follows. For purpose of illustration, a cycle of the operation of the apparatus begins under the conditions shown in FIG. 1 in which (1) the element-forming filamentary material 23 is displaced by the pusher arm 31 outside the warp threads 12, 13, 14 beyond the hook 26 into hooked engagement therewith, (2) the weft thread 19 inserted by the filling carrier 18 through the upper warp shed 16 is ready for hooked engagement with the knitting needle 21, and (3) the reed 20 is retracted in a position away from the fell 15 of the stringer tape 11 being woven. Then, the rocker arm 25 is actuated to move angularly in the direction indicated by the arrow in FIG. 1 whereupon the hook 26 moves from the second position of FIG. 1 to the first position of FIGS. 2 and 3. At the same time, the reed 20 is actuated to move forward to beat the weft thread 19 just inserted against the fell 15. During that time, the element-forming filamentary material 23 is coiled around the hook's nose portion 26*b* substantially in parallel relation to the fell 15 to thereby form a coupling element 24.

Thereafter, while the rocker arm 25 and hence the hook 26 is at rest at the first position shown in FIGS. 2 and 3, the reed 20 is retracted away from the fell 15, then the heddle 15*a* is actuated to move the warp threads 12, 13, 14 up and down across the warp sheds 16, 17, and the filling carrier 18 is again actuated to insert the weft thread 19 in the upper warp shed 16. After the reed 20 has beat the weft thread 19 just inserted against the fell 15, the rocker arm 25 moves angularly away from the fell 15 to bring the hook 26 into the second position shown in FIG. 1. Simultaneously therewith, the reed 20 is moved back again to its retracted position. Finally, the heddle 15*a* is actuated to change the respective positions of the warp threads 12, 13, 14 into those shown in FIG. 1, to thereby complete a cycle of operation of the apparatus.

Figure 4:
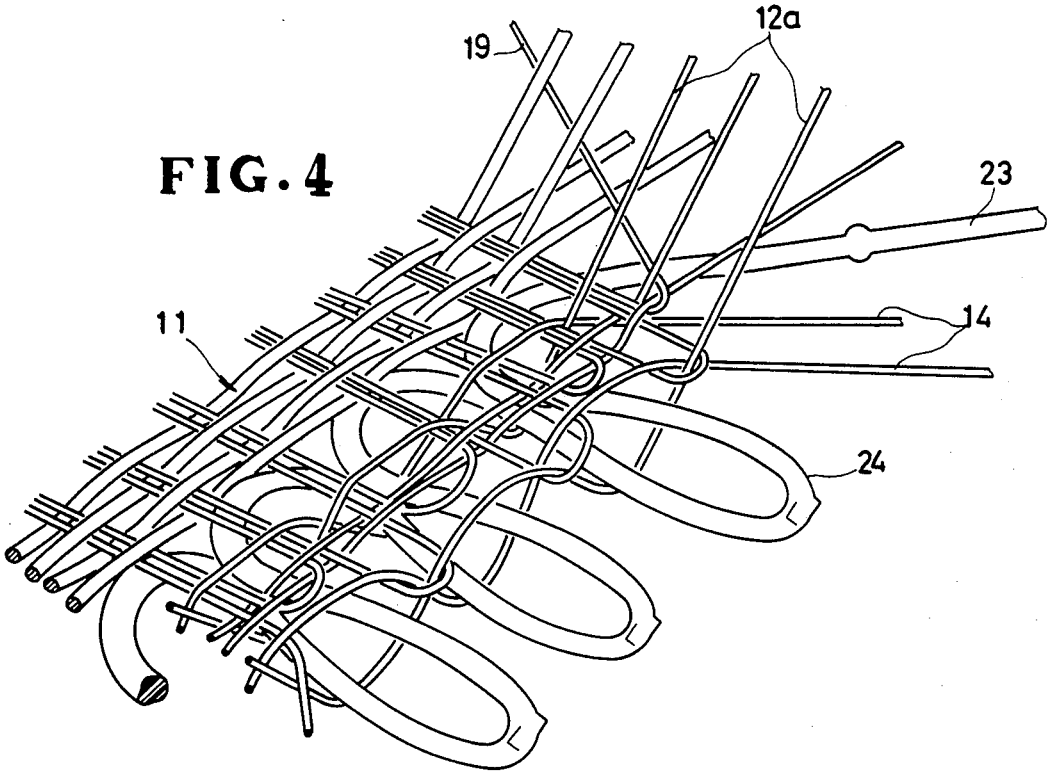
FIG. 4 is an enlarged perspective view of a portion of the slide fastener stringer as being produced, the parts not shown being in the position of FIG. 1.

FIG. 4 shows the structure of a woven slide fastener stringer being woven on the apparatus, the stringer having the row of coupling elements 24 woven integrally into the stringer tape 11. The row of coupling elements 24 is fixed to the stringer tape 11 along a longitudinal edge thereof by the binding warp threads 12*a*, 14 running respectively along undulated paths in symmetrical patterns in such a manner as to overlie one of the legs of the coupling elements 24 and to interlace with the weft thread 19 under the other of the legs of the coupling elements 24.

With the apparatus thus arranged, the warp threads 12, 13, 14 are protected from interfering with or otherwise being damaged by the hook 26 because the movement of the hook 26 is limited to take place only outside the warp threads 12, 13, 14, with the result that the apparatus can be operated at a higher speed and hence produces the woven slide fastener stringer at an increased rate of production.

Figure 7:
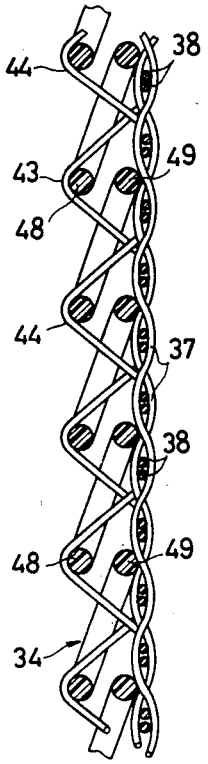
FIG. 7 is a longitudinal cross-sectional view taken along line VII—VII of FIG. 5.

FIGS. 5–7 show an example of woven slide fastener stringers 33 produced by the apparatus of the present invention. The slide fastener stringer 33 comprises a row of coiled coupling elements 34 formed of synthetic resin fixed to a slide fastener stringer tape 35 woven of foundation warp threads 36, 37 and a single foundation weft thread 38, the row of coupling elements 34 extending along a longitudinal edge portion 39 of the stringer tape 35. The foundation warp threads 36 and the foundation weft thread 38 jointly constitute a web portion 40 of the stringer tape 35, and the foundation warp threads 37 and the foundation weft thread 38 jointly constitute the longitudinal edge portion 39 of the stringer tape 35. The warp threads 36 are thicker than the warp threads 37. The row of coupling elements 34 is secured to the stringer tape 35 by means of a binding thread system including a pair of first binding warp threads 41, 42 and a plurality of second binding warp threads 43, 44, 45, 46.

Each of the coupling elements 34 comprises a coupling head 47 projecting transversely beyond the longitudinal edge portion 39 of the stringer tape 35, and a pair of upper and lower legs 48, 49 (FIGS. 6 and 7) extending from the coupling head 47 in a common direction and spaced from each other vertically in a direction substantially perpendicular to the general plane of the stringer tape 35. The upper and lower legs 48, 49 are blended into and interconnected by a heel portion 50 located remotely from the coupling head 47. The lower legs 49 of the coupling elements 34 are mounted on the longitudinal edge portion 39 of the stringer tape 35. The foundation weft thread 38 is inserted in double picks between adjacent coupling elements 34 so that there is a pair of picks of the foundation weft thread 38, one on each side of each of the lower legs 49 of the coupling elements 34 as shown in FIGS. 5 and 7.

The first binding warp threads 41, 42 of the binding thread system are disposed above one end of the heel portions 50 of two adjacent coupling elements 34 and respectively alternately extend below the next two pairs of picks of the foundation weft thread 38. Likewise, the second binding warp threads 43–46 are disposed on the upper legs 48 of the coupling elements 34 and respectively alternately extend below the next two pairs of picks of the foundation weft thread 38. The warp threads 43–46 run along undulated paths in out-of-phase relation to one another and are disposed between a pair of groups of the foundation warp threads 37 spaced laterally from each other. The first binding warp threads 41, 42 are preferably made of elastic yarns for neatly binding the coupling elements 34 and are thicker than the warp and weft threads 43–46, 37 in the longitudinal edge portion 39 of the stringer tape 35.

With the arrangement described above, the binding warp threads 41, 42, 43–46 secure the row of coupling elements 34 to the longitudinal edge portion 39 of the stringer tape 35 in substantially the same manner as rows of sewing stitches, and there is no weft thread extending between the upper and lower legs 48, 49 of the coupling elements 34 in the space between adjacent coupling elements 34. The coupling elements 34 thus secured have a certain degree of flexibility which is enough to follow the movement of the slide fastener stringer 33, and provide a sufficient degree of coupling strength which enables opposite rows of coupling elements to mesh with each other firmly against the danger of becoming accidentally separated. Furthermore, the weft thread 38 inserted in double picks makes the longitudinal edge portion 39 compact and resilient in structure, and the coupling elements 34 are secured to such longitudinal edge portion 39 with the lower legs 49 received between respective pairs of picks of the weft thread 38 and the upper legs 48 biased by the binding warp threads 43–46 toward the lower legs 49. With this arrangement, the coupling elements 34 are strong enough to withstand not only torsional stress but also external forces applied thereto in a direction perpendicular to the general plane of the stringer tape 35.

Figure 8:
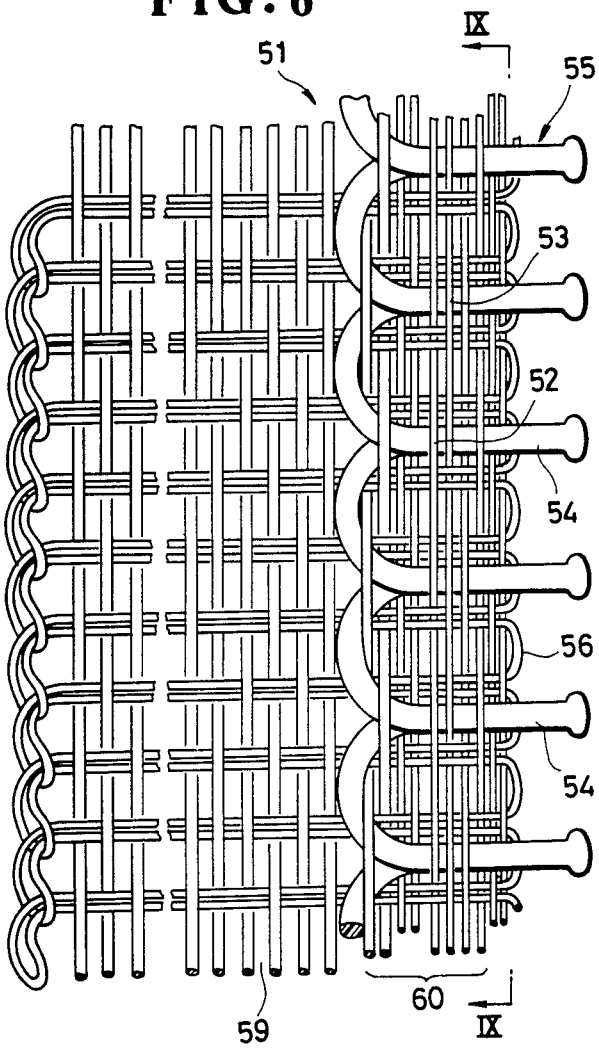
FIG. 8 is a view similar to FIG. 5 of another embodiment of the present invention.
Figure 9:
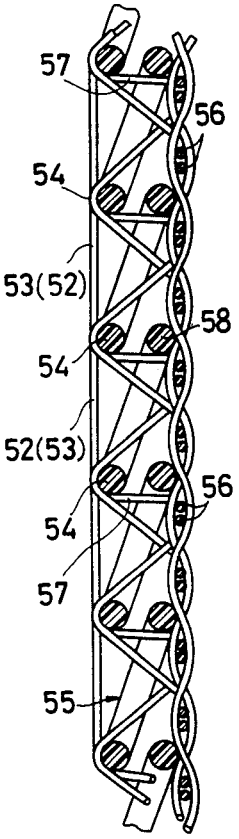
FIG. 9 is a longitudinal cross-sectional view taken along line IX—IX of FIG. 8.

Another woven slide fastener stringer 51 produced on the apparatus of the invention is shown in FIGS. 8 and 9. The woven slide fastener stringer 51 is substantially the same as the stringer 33 of the foregoing embodiment with the exception that two out of four second binding warp threads 52, 53 extend transversely across adjacent pairs of upper legs 54 of a row of coupling elements 55 and are interlaced with one pick of every other one of pairs of picks of a foundation weft thread 56. Each of the binding warp threads 52, 53 has portions 57 extending between the upper legs and corresponding lower legs 58 of the coupling elements 55 substantially normal to the general plane of the woven stringer tape 59 of the stringer 51. With the binding warp threads 52, 53 having the portions 57, the coupling elements 54 can be secured more positively to a longitudinal edge portion 60 of the stringer tape.

Although various minor modifications may be suggested by those versed in the art, it should be understood that I wish to embody within the scope of the patent warranted hereon, all such embodiments as reasonably and properly come within the scope of my contribution to the art.

I claim:

1. A woven slide fastener stringer comprising:

(a) a woven stringer tape including a longitudinal edge portion woven of a plurality of foundation warp threads and a single foundation weft thread;

(b) a row of continuous filamentary coupling elements disposed on a side of said longitudinal edge portion and spaced longitudinally from each other, each of said coupling elements including a coupling head projecting transversely beyond said longitudinal edge portion, a pair of first and second legs extending from said coupling head in a common direction and spaced from each other in a direction substantially perpendicular to the general plane of said longitudinal edge portion, and a heel portion located remotely from said coupling head and interconnecting one of said first and second legs to another leg of an adjacent coupling element, said first legs being mounted against one side of said longitudinal edge portion, said foundation weft thread having two pairs of picks for each of said first legs with one pair of picks disposed at each side of each said first leg; and (c) a binding warp thread system securing said row of continuous filamentary coupling elements to said edge portion and including at least one pair of first binding warp threads respectively disposed above and below said heel portions and respectively passing alternately over and under, and under and over, said two pairs of picks, and a plurality of second binding warp threads passing over at least some of said second legs and extending below at least one of said pairs of picks of said foundation weft thread in out-of-phase relation to one another.

2. A woven slide fastener stringer according to claim 1, said foundation warp threads being separated into two groups spaced laterally from each other, said second binding warp threads extending between said groups of said foundation warp threads.

3. A woven slide fastener stringer according to claim 1, said first binding warp threads comprising an elastic yarn thicker than said foundation warp and weft threads and said second binding warp threads.

4. A woven slide fastener stringer according to claim 1, at least some of said second warp binding threads respectively passing over and under, and under and over, said two pairs of picks of said foundation weft thread.

5. A woven slide fastener stringer according to claim 1, including at least four of said second binding warp threads, two of which extend transversely across adjacent pairs of said second legs and then alternately extend below every fourth pair of picks of said foundation weft thread, the other two second binding warp threads respectively extending over and under, and under and over, said two pairs of picks of said foundation weft thread.

6. A woven slide fastener stringer comprising:

(a) a woven stringer tape including a longitudinal edge portion woven of a plurality of foundation warp threads and a single foundation weft thread, said foundation warp threads of said edge portion being separated into two groups spaced transversely of said longitudinal edge portion;

(b) a row of continuous filamentary coupling elements disposed on said longitudinal edge portion and spaced longitudinally from each other, each of said coupling elements including a coupling head projecting transversely beyond said longitudinal edge portion, a pair of first and second legs extending from said coupling head in a common direction and spaced from each other in a direction substantially perpendicular to the general plane of said longitudinal edge portion, and a heel portion located remotely from said coupling head and interconnecting one of said first and second legs to another leg of an adjacent coupling element, said first legs being secured against one side of said longitudinal edge portion, there being a pair of picks of said foundation weft thread, one on each side of said first leg; and (c) a binding warp thread system securing said row of continuous filamentary coupling elements to said longitudinal edge portion of said stringer tape, said binding warp thread system including at least a pair of first binding warp threads disposed between all of said foundation warp threads of said edge portion and said heel portions of said coupling elements, and a plurality of second binding warp threads disposed between said two groups of said foundation warp threads, each of said first and second binding warp threads being interwoven with every other pair of picks of said foundation weft thread and extending alternately over and under said legs of said coupling along the entire length of said longitudinal edge portion, each of said foundation warp threads of said edge portion being interwoven with every other pair of picks of said foundation weft thread and extending under said legs of every one of said coupling elements along the entire length of said edge portion.

* * * * *